US006104121A

United States Patent [19]

Thurn

[11] Patent Number: 6,104,121

[45] Date of Patent: Aug. 15, 2000

[54] ULTRASONIC TRANSDUCER WITH A DISK-SHAPED QUARTER WAVE LENGTH TRANSFORMER

[75] Inventor: Rudolf Thurn, Pressath, Germany

[73] Assignee: Siemens AG, Munich, Germany

[21] Appl. No.: 09/230,632

[22] PCT Filed: Jul. 15, 1997

[86] PCT No.: PCT/DE97/01493

§ 371 Date: Apr. 22, 1999

§ 102(e) Date: Apr. 22, 1999

[87] PCT Pub. No.: WO98/04361

PCT Pub. Date: Feb. 5, 1998

[30] Foreign Application Priority Data

Jul. 26, 1996 [DE] Germany ..... 196 30 350

[51] Int. Cl.[7] ..... B06B 1/06

[52] U.S. Cl. ..... 310/321; 310/328

[58] Field of Search ..... 310/312, 321, 310/323.01, 323.02, 323.03, 323.04, 323.05, 323.12, 323.17, 323.18, 328, 338

[56] References Cited

U.S. PATENT DOCUMENTS

| | | | |
|---|---|---|---|
| 4,641,054 | 2/1987 | Takahata et al. | 310/324 |
| 4,823,042 | 4/1989 | Coffey et al. | 310/322 |

FOREIGN PATENT DOCUMENTS

| | | | |
|---|---|---|---|
| 0 178 346 | 4/1986 | European Pat. Off. | H04R 17/10 |
| 0 420 758 | 4/1991 | European Pat. Off. | A61B 8/00 |
| 0 655 156 | 6/1996 | European Pat. Off. | G10K 11/02 |
| 0655156 | 6/1996 | European Pat. Off. | G10K 11/02 |
| 39 11 047 | 10/1990 | Germany | H04R 17/00 |
| 44 23 639 | 3/1996 | Germany | H04R 17/00 |
| 195 27 018 | 2/1997 | Germany | H04R 17/00 |

*Primary Examiner*—Nestor Ramirez
*Assistant Examiner*—Eliza Stefaniw
*Attorney, Agent, or Firm*—Kenyon & Kenyon

[57] ABSTRACT

An ultrasonic transducer having a narrow principal lobe opening angle simultaneously with low secondary lobe amplitudes is provided. The ultrasonic transducer invention has a disk-shaped quarter-wave transformer element whose peripheral surface is configured as a stepped profile.

6 Claims, 1 Drawing Sheet

ULTRASONIC TRANSDUCER WITH A DISK-SHAPED QUARTER WAVE LENGTH TRANSFORMER

FIELD OF THE INVENTION

The present invention relates to an ultrasonic transducer having a disk-shaped piezoceramic element and having a disk-shaped quarter-wave transformer element.

BACKGROUND INFORMATION

In ultrasonic converters have ultrasonic sensors and proximity switches conventional a relatively narrow acoustic lobe characteristics, and at the same time have comparatively low secondary lobe amplitudes. The quarter-wave transformer element serves to emit and receive ultrasonic waves in a gaseous propagation medium, preferably for use in ultrasonic proximity switches.

German Patent No. 39 11 047 C2 has already disclosed an ultrasonic transducer having a piezoceramic element and a transformer element, in which the surface of the transformer element facing away from the piezoceramic element has a surface area which is slightly different as compared with the base area of the piezoceramic element and with the area of the transformer element which faces the latter. In this context, the lateral line of the transformer element is divergent or convergent, with a straight, concave, or convex profile. The acoustic lobe characteristic achievable therewith, having considerable secondary lobe amplitudes of approximately −19 dB with respect to the principal lobe amplitude, is insufficient for use of the ultrasonic transducer, for example, in confined environmental conditions and in the presence of lateral interfering objects.

European Patent No. 0 655 156 describes an ultrasonic transducer having a transformer element with a cylindrical enveloping surface, which has an indentation on the enveloping surface and/or on the surface facing the piezoceramic element. This indentation allows highly directional acoustic lobes with low secondary lobe amplitudes of less than −30 dB.

SUMMARY OF THE INVENTION

An object of the present invention is to improve an ultrasonic transducer of the kind recited above in such a way that it simultaneously has narrow principal lobe opening angles and low secondary lobe amplitudes.

The object is achieved by configuring the lateral peripheral surface of the quarter-wave transformer element as a stepped profile.

DETAILED DESCRIPTION

Figure 1:
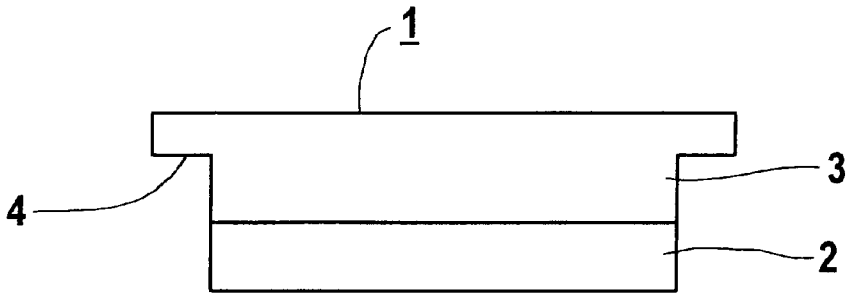
FIG. 1 shows an ultrasonic transducer with a right-angled stepped profile.

FIG. 1 shows a sectioned illustration of an embodiment according to the present invention of an ultrasonic transducer 1 having a cylindrical, disk-shaped piezoceramic element 2 and, for example adhesively bonded thereto, a disk-shaped transformer element 3. The lateral peripheral surface of transformer element 3 is configured here as a simple right-angled stepped profile 4. In the simplified depiction shown in FIG. 1 the upper and lower metallization surfaces of piezoceramic element 2, as well as the metallization surface facing transformer element 3—to which contact is made, for example, via a thin contacting foil made of metal or a metal-plastic composite material and inserted into the adhesive layer—are not shown. The advantageous configuration of the lateral stepped contour results in favorable oscillation forms of the outward-facing, acoustically radiating surface of transformer element 3, resulting in highly directional acoustic lobes with very low secondary lobe amplitudes. In one exemplary embodiment, the diameter of the disk-shaped piezoceramic element 2 and the diameter of the base surface facing piezoceramic element 2 of transformer element 3 is 23 mm. The diameter of the outward-facing surface of transformer element 3 is 28 mm, the overall height of transformer element 3 is 6.5 mm, and the height of the projecting portion of the transformer element with the 28-mm diameter is 2.4 mm. Transformer element 3 consists of a robust syntactic foam made of a mixture of epoxy and hollow glass spheres. The term syntatic foam implies, for example, a mixture of polymercast resin as a matrix and a filler of hollow microspheres made of glass or synthetic materials. In contrast to blown foams, syntatic foam receives its porous foam structure only from this porous filler. The exemplary ultrasonic transducer 1 has a resonant working frequency of approximately 80 kHz with a −3 dB width for the acoustic lobe opening angle of approximately 11 degrees, and very low secondary lobe amplitudes of approximately −30 dB.

Figure 2:
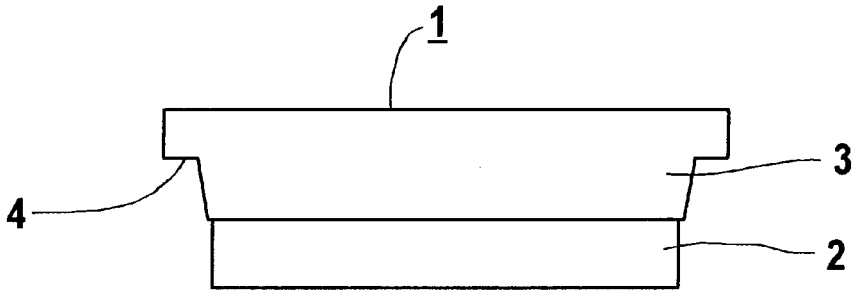
FIG. 2 shows an ultrasonic transducer with a non-right-angled stepped profile.
Figure 3:
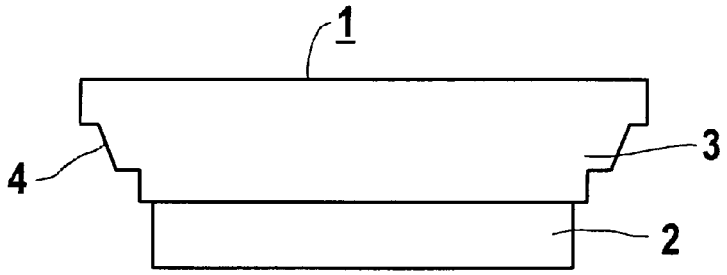
FIG. 3 shows an ultrasonic transducer having a stepped profile including a right-angled step and a non-right-angled step.

FIG. 2 shows a further embodiment of ultrasonic transducer 1 according to the present invention, with a stepped profile whose surfaces are not at right angles to one another. Further possible embodiments result if the stepped profile is made up of two of more right-angled and/or non-right-angled steps. The resulting increasing diameter of the acoustically radiating surface of transformer element 3 results in a narrower acoustic lobe opening angle.

Although the present invention is explained with reference to the embodiments depicted in the drawings, it should be borne in mind that the intention is not to limit the present invention to only the embodiments depicted, but rather to include all possible changes, modifications, and equivalent arrangements to the extent they are covered by the content of the patent's claims.

What is claimed is:

1. An ultrasonic transducer, comprising:

a disk-shaped piezoceramic element; and a disk-shaped quarter-wave transformer element having a lateral peripheral surface and an acoustically radiating base surface, the lateral peripheral surface having a stepped profile, the acoustically radiating base surface facing away from the piezoceramic element and being planar and larger than a base surface of the piezoceramic element.

2. The ultrasonic transducer according to claim 1, wherein the acoustically radiating base surface deviates from the base surface of the piezoceramic element by no more than 20% in area.

3. The ultrasonic transducer according to claim 1, wherein the acoustically radiating base surface is at least 30% larger than the base surface of the piezoceramic element.

4. The ultrasonic transducer according to claim 1, wherein the stepped profile includes a single step having surfaces aligned at right angles to one another.

5. The ultrasonic transducer according to claim 1, wherein the stepped profile includes oblique surfaces not at right angles with one another.

6. The ultrasonic transducer according to claim 1, wherein the stepped profile includes at least two steps, the at least two steps being selected from a group of steps that includes right-angled steps and non-right-angled steps.

* * * * *